United States Patent [19]

Matsui et al.

[11] Patent Number: 4,634,066

[45] Date of Patent: Jan. 6, 1987

[54] ARTICLE CONVEYING AND HANDLING SYSTEM

[75] Inventors: Isamu Matsui, Kyoto; Hiroshi Uchida, Oumihachiman, both of Japan

[73] Assignee: Murata Kikai Kabushiki Kaisha, Kyoto, Japan

[21] Appl. No.: 645,019

[22] Filed: Aug. 28, 1984

[30] Foreign Application Priority Data

Aug. 29, 1983 [JP] Japan ..... 58-158276

[51] Int. Cl.[4] ..... B65H 67/06

[52] U.S. Cl. ..... 242/35.5 A; 198/351; 198/465.1

[58] Field of Search ..... 242/35.5 A, 35.5 R, 242/35.6 R; 198/348, 349, 351, 362, 366, 370, 472, 793

[56] References Cited

U.S. PATENT DOCUMENTS 1,822,111 9/1931 Richardson et al. ..... 198/351 X 2,818,161 12/1957 Marsh ..... 198/351

3,530,571 9/1970 Perry ..... 198/349 X 3,563,479 2/1971 Brouwer et al. ..... 242/35.5 R 3,929,076 12/1975 McRae, Jr. et al. ..... 198/349 X 4,545,551 10/1985 Uchida et al. ..... 242/35.5 A

FOREIGN PATENT DOCUMENTS 3326000 1/1984 Fed. Rep. of Germany ..... 242/35.5 A

*Primary Examiner*—Stanley N. Gilreath

*Attorney, Agent, or Firm*—Spensley Horn Jubas & Lubitz

[57] ABSTRACT

A system for conveying and handling articles of different kinds comprising a main conveyor line shared among the articles of different kinds; branch lines especially for the articles of different kinds branched from the main conveyor line and merging again into the main conveyor line; and stations disposed midway of the branched lines for handling the articles of different kinds. The article is a spinning bobbin and the bobbin is conveyed to be fitted and erected on a carrier members.

2 Claims, 18 Drawing Figures

ARTICLE CONVEYING AND HANDLING SYSTEM

BACKGROUND OF THE INVENTION

The present invention relates to an article supplying and conveying system.

For example, in case yarns of different kinds such as of different yarn number counts or of yarn kinds are to be taken up by one automatic winder, if this winder is substantially divided into a plurality of winding sections so that an article, i.e., a spinning bobbin of the same kind may be wound up at each of said sections, it is necessary to supply a spinning bobbin of another kind to each winding section without any confusion.

As spinning bobbin conveying means, moreover, there is a system in which each spinning bobbin is conveyed by one carrier member such as a peg carrier having a peg erected at the center of a disc to fit the spinning bobbin in an upright position.

In order that spinning bobbins of different kinds may be supplied by the spinning bobbin carrying means using the peg carriers to the individual winding sections without any confusion, carrier paths especially for the spinning bobbins are provided and arranged in a closed loop form between spinning bobbin supply stations for fitting the spinning bobbins on the carriers and the winding sections. With this arrangement, no confusion is caused among the spinning bobbins of different kinds, but the spaces for the carrier paths become the larger for the more kinds so that they are required more than the spaces for mounting the winder itself.

SUMMARY OF THE INVENTION

An object of the present invention is to provide a system in which paths for spinning bobbins of different kinds are constructed of one common conveyor path so that the spinning bobbins may be supplied and conveyed neither any confusion with peg carriers especially for the spinning bobbins of individual kinds being conveyed on said conveyor path nor any delay of the carriers on the conveyor path.

According to the present invention, more specifically, there is provided a system for conveying and handling articles of different kinds, which comprises: a main conveyor line shared among the articles of different kinds; branch lines especially for the articles of different kinds branched from said main conveyor line and merging again into said main conveyor line; and stations disposed midway of said branch lines for handling said articles of different kinds.

DETAILED DESCRIPTION OF THE INVENTION

The present invention will be described in the following in connection with the embodiments thereof with reference to the accompanying drawings in case it is applied to a system for supplying and conveying spinning bobbins of many kinds.

Figure 1:
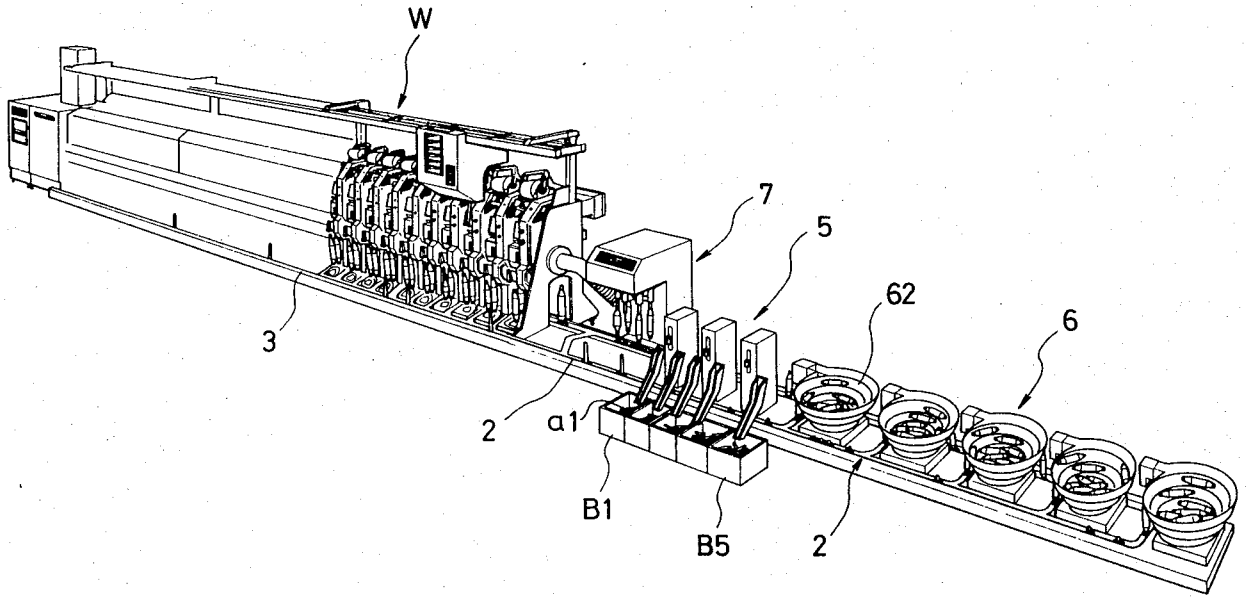
FIG. 1 is a perspective view showing one embodiment of the system of the present invention.
Figure 2:
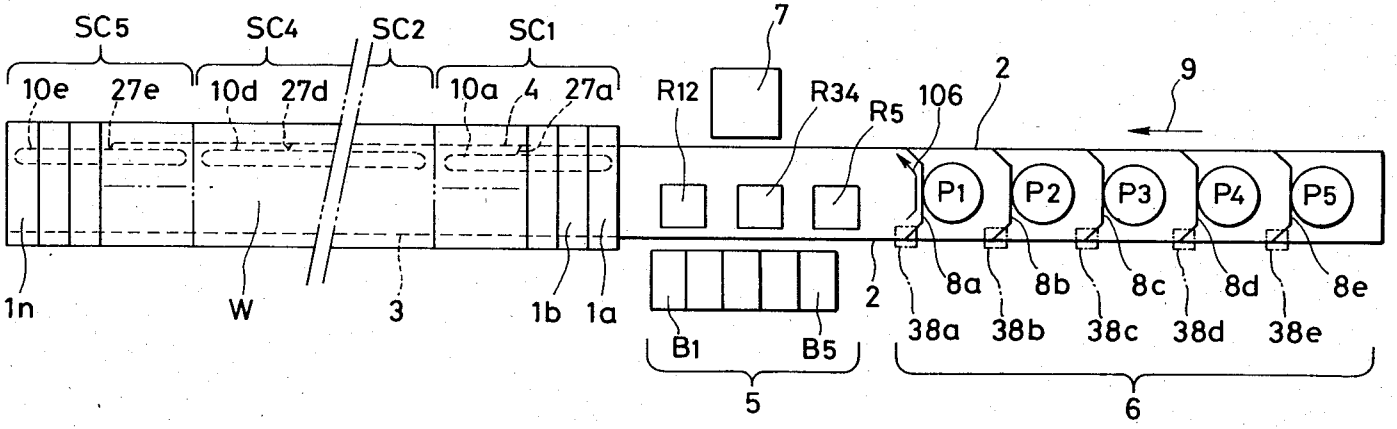
FIG. 2 is a top plan view showing the layout of the same system.

In FIGS. 1 and 2, an automatic winder W is constructed of a multiplicity of winding units 1*a* to 1*n* which are juxtaposed to one another and which are substantially divided into five winding sections SC1 to SC5 respectively therefor in the present embodiment.

The supply of spinning bobbins to the aforementioned winder W and the delivery of empty bobbins therefrom are conducted through a main conveyor line 2 in a closed loop form. More specifically, the main conveyor line 2 has both its ends connected to a bobbin return path 3 and a spinning bobbin supply path 4 at the side of the winder W, and a bobbin handling zone 5, a spinning bobbin supply zone 6 and a yarn end finding device 7 are arranged along the main conveyor line 2 in the direction of transfer of carrier members (which will be called "carriers" in the following).

The aforementioned bobbin handling zone 5 is one in which, of the bobbins discharged from the winder, the empty bobbins having no yarn in the least and the small amount of yarn bobbins as cannot be resupplied to the winder are extracted from the carriers so that they may be selectively handled and conveyed. In said zone, bobbin handling devices R12, R34 and R5 are disposed midway of the main conveyor line 2. The bobbin handling device R12 is of the type, in which bobbins a and b of two kinds, i.e., empty bobbins and small amount of yarn bobbins. The device R34 likewise handles bobbins c and d of other kinds. The device R5 selects empty bobbins and small amount of yarn bobbins of the remaining one kind.

Incidentally, the bobbins to be discharged to the aforementioned bobbin return path 3 from the winding units further include partial-bobbins having such a large quantity of yarn left as can be resupplied to the winding units. These partial-bobbins are conveyed at the bobbin handling zone 5 without being extracted and pass through the spinning bobbin supply zone 6 without being supplied with any spinning bobbin.

The spinning bobbin supply zone 6 is further equipped with such a number of branch lines 8*a* to 8*e*, which are branched from the main conveyor line 2 and merged again into the same line 2 as is equal to that of the kinds (e.g., five kinds in the present embodiment) of the spinning bobbins. Midway of the aforementioned branch paths 8*a* to 8*e*, respectively, there are disposed spinning bobbin supply stations P1 to P5, of which: the spinning bobbin a is supplied and fitted at the station P1 to the carrier especially therefor; the spinning bobbin b is supplied and fitted at the station P2 to the carrier especially therefor; the spinning bobbin c is supplied and fitted at the station P3 to the carrier especially therefor; the spinning bobbin d is supplied and fitted at the station P4 to the carrier especially therefor; and the spinning bobbin e is supplied and fitted at the station P5 to the carrier especially therefor.

Either the carriers having their spinning bobbins supplied at the aforementioned zone 6 or the carriers having partial-bobbins passed therethrough are conveyed on the main conveyor line 2 in the direction of arrow 9 and supplied to the common yarn end finding device 7, by which their yarn ends are sought, and the spinning bobbins of multiple kinds are then conveyed at random on the main conveyor line 2 toward the winder W.

Figure 3:
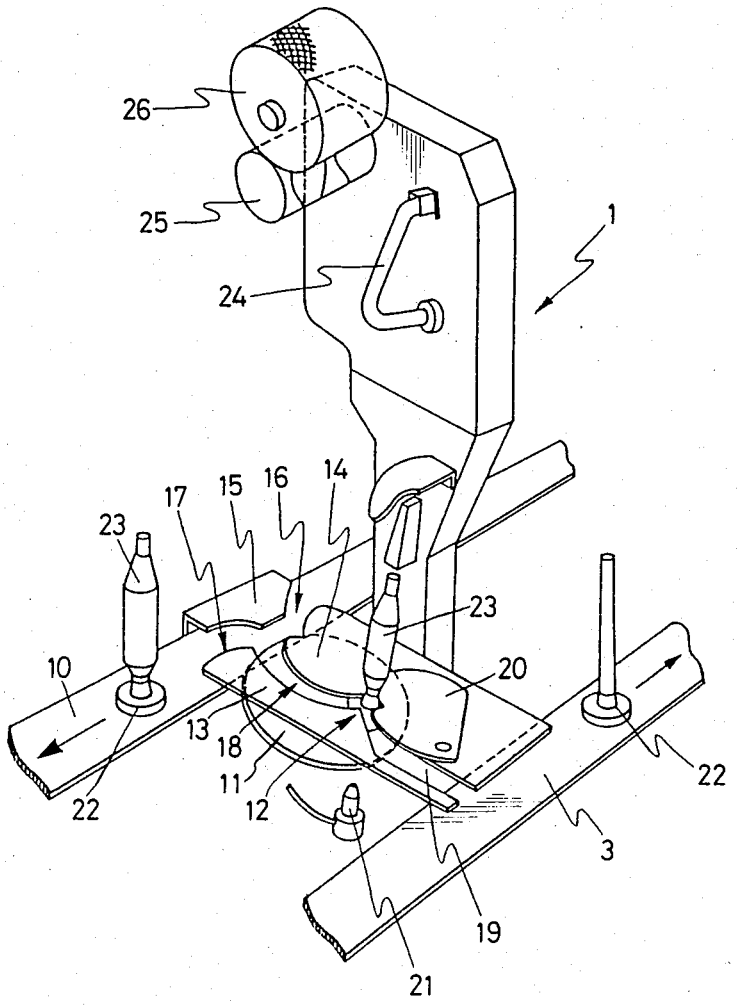
FIG. 3 is a perspective view showing one example of the winding unit of the winder which is applied to the aforementioned system.

FIG. 3 shows one example of the winding unit of the winder, which is applied to the aforementioned system. Specifically, the plural winding units 1 are juxtaposed to one another to construct the single winder W and are interposed between a spinning bobbin distribution path 10 and the empty bobbin return path 3. Indicated at reference numeral 11 is a rotary disc for discharging onto the return path 3 the empty bobbins which have been conveyed on the distribution path 10 to a re-winding position 12 where they are wound up and emptied. Above said rotary disc 11, there are disposed guide plates 13 and 14 which are arranged at a predetermined spacing from each other. A bobbin inlet port 16 and an excess bobbin outlet port 17 are formed between the guide plate 14 and another guide plate 15, and a bobbin stand-by line 18 and a bobbin eject line 19 are formed between the guide plates 13 and 14. The connection between the aforementioned bobbin stand-by line 18 and bobbin eject line 19 is located at the aforementioned re-winding position. Numeral 20 indicates a lever for discharging the empty bobbins or the partial-bobbins.

Below the carrier of the aforementioned re-winding position, there is disposed a compressed air injection nozzle 21 which has communication through a conduit with a not-shown compressed air supply source. The compressed air is injected by said nozzle 21 from the inside of the carrier of a carrier 22 through a not-shown arcuate slit, which is formed in the rotary disc 11, into the take-up tube of the spinning to blow up the yarn end, which depends from the upper end of the core thereinto, upwardly of the outside of the take-up tube. An intermediate pipe 24 standing by above the spinning bobbin 23 of the re-winding position 12 sucks and holds the yarn end blown up to turn it up and introduce it into a knotter so that the yarn end at the package side and the yarn end at the bobbin side are knotted to start the re-winding operation. Numeral 25 indicates a traverse drum, and numeral 26 indicates a take-up package.

The winding units 1 thus constructed are juxtaposed to one another, as shown in FIG. 1, and one spinning bobbin distribution path 10 forms one of closed loops 10*a* to 10*e* in each of the winding sections SC1 to SC5 and is connected with the bobbin supply path extending through each section with one of branch paths 27*a* to 27*e*. A later-described bobbin selecting device is disposed at the inlet side of each branch path so that each spinning bobbin is supplied to a predetermined winding section, where it is to be taken up, such that the spinning bobbin a is conveyed onto the spinning bobbin distribution path 10*a* of the section SC1 whereas the spinning bobbins b to e pass over the branch passage 27*a* and the spinning bobbin d is conveyed from the branch path 27*d* onto the distribution path 10*d* of the section SC4.

At each section, as shown in FIG. 3, the spinning bobbin 23 having been transferred on the distribution path 10 is transferred onto the rotary disc, as its carrier 22 comes into abutment against the guide plates 13, 14 and 15 of the winding unit 1, to come from the bobbin inlet port 16 into the bobbin stand-by line 18 until it reaches the re-winding position 12. Thus, when the succeeding spinning bobbins consecutively enter the bobbin stand-by line 18 so that this line 18 is filled up with a predetermined number of spinning bobbins, the spining bobbins sent thereafter cannot enter the stand-by line so that they are turned from the excess bobbin outlet port 17 toward the subsequent unit. In these ways, the carriers having the spinning bobbins fitted thereon fill up the winding units consecutively from the unit 1*a* closest to the yarn end finding device 7 to the remaining units 1*b* to 1*n*. When the bobbin stand-by line 18 becomes empty, the units positioned closer to the winding unit 1*a* are consecutively occupied.

Next, the carrier to be applied to the aforementioned system will be explained with reference to FIG. 4.

Figure 4A:
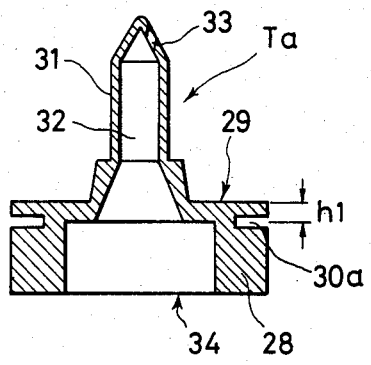
FIGS. 4*a* to 4*e* are partially sectional front elevations showing the kinds of the peg carriers which are applied to the same system.

Since five kinds of spinning bobbins are handled in the present embodiment, specifically, five kinds of carriers Ta to Te are used. In FIG. 4, the carrier Ta shown in FIG. 4*a* is one for the spinning bobbin of the kind a, which is formed with an annular discrimination groove 30*a* at a distance h1 from a reference face 29 of a cylindrical base 28 of the carrier. This cylindrical base 28 is formed at its center integrally with a peg 31, on which the spinning bobbin is fitted and supported. Moreover, the aforementioned carrier Ta has its inside formed with a space 32 which has communication with an air injection port 33 formed in the leading end slope of the peg.

Figure 4B:
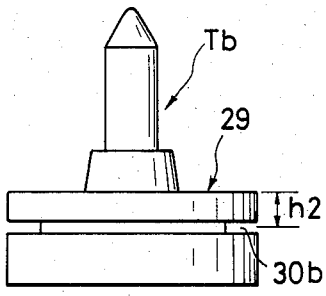
Figure 4C:
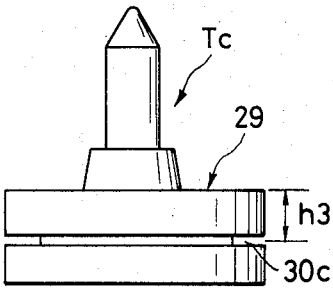
Figure 4D:
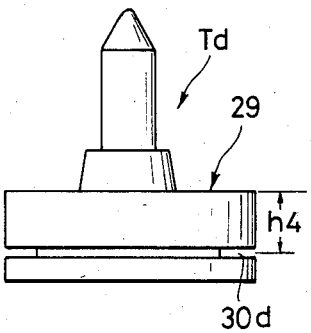
Figure 4E:
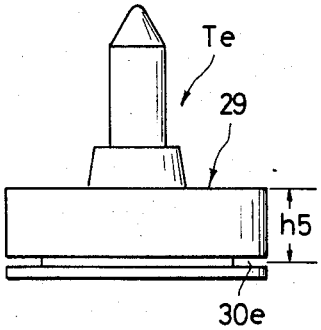

FIG. 4*b* shows the carrier Tb especially for the spinning bobbin of the kind b, which has a construction similar to that of the carrier Ta except that a discrimination groove 30*b* is formed at a distance h2 from the reference face 29. In the following, the carriers Tc, Td and Te are used especially for the spinning bobbins of the kinds c, d and e and formed with discrimination grooves 30*c*, 30*d* and 30*e* located at distance h3, h4 and h5 from the reference face 29. Incidentally, the aforementioned discrimination groove 30*a* is equi-distantly spaced from all the circumference of the base 28 so that it extends in parallel with the base 28. This parallel extension also applies to the other discrimination grooves 30*b* to 30*e*. Incidentally, the reason why the upper face of the base 28 is used as the reference face 29 comes from a fear that the groove position is displaced from the conveyor surface by the undulations of the conveyor surface or by the adhesion of dust even if a detecting member for detecting the later-described discrimination groove is fixed at a predetermined distance from the conveyor surface, because the base 28 is conveyed with its lower face 34 placed on the conveyor line which is formed of the conveyor belt.

Figure 5:
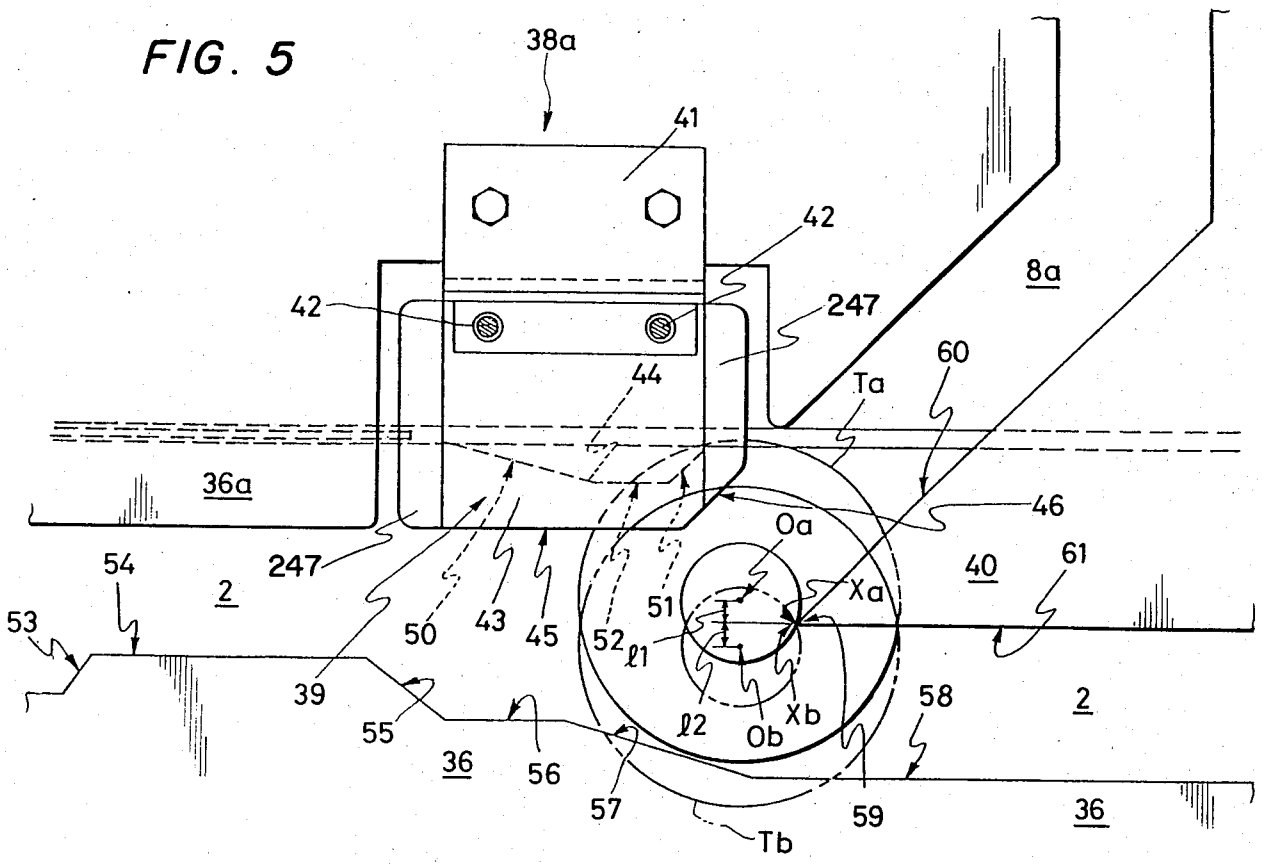
FIG. 5 is a top plan view showing the selecting device of the same carriers.

Next, the selecting device for selecting the kinds of the aforementioned carriers will be explained with reference to FIGS. 5 to 7. The main conveyor line 2 is constructed of a conveyor belt 35 and stationary guide plates 36 and 36*a* which are positioned at a predetermined spacing from the surface of said conveyor belt 35, so that the carrier Ta is conveyed, while being guided, with its base 28 having its lower face placed on the conveyor belt 35 and with its colum-shaped pedestal 37 having its circumferential side face interposed between the aforementioned guide plate 36 and 36*a*.

A selecting device 38*a* at a branch point, e.g., an inlet side branch point of the branch line 8*a* of FIGS. 1 and 2, for example, will be explained in the following. At the branch point, there are arranged subsequent to a guide plate 36*a*, as shown in FIG. 5, a carrier selecting member 39, and a selecting guide member 40 for distributing the carriers in two directions. The aforementioned selecting member 39 is constructed of: a reference plate 43 which is loosely fitted on pins 42 and 42 fixed on a stationary bracket 41 so that it can freely swing vertically about the pins 42 within a range of an angle $\theta$; and a selecting gauge 44 which is fixed to said reference plate 43 below and at the spacing h1 from the same and in parallel with the same.

The side edge of the aforementioned reference plate 43 is formed of a parallel portion 45, which is parallel to the conveyor running direction, and a sloped portion 46 which leads from said parallel portion 45 and which is sloped toward the bobbin supply station. Said reference plate 43 has both its ends formed with expanded portions 247 and 247 which are so directed upward as to raise no obstruction to the entrance and delivery of the carriers. Moreover, the lower face 43*a* of the plate between the expanded portions 247 and 247 provides a reference face, which is brought into abutment against the upper face 29 of the base 28 of the carrier Ta.

Figure 6:
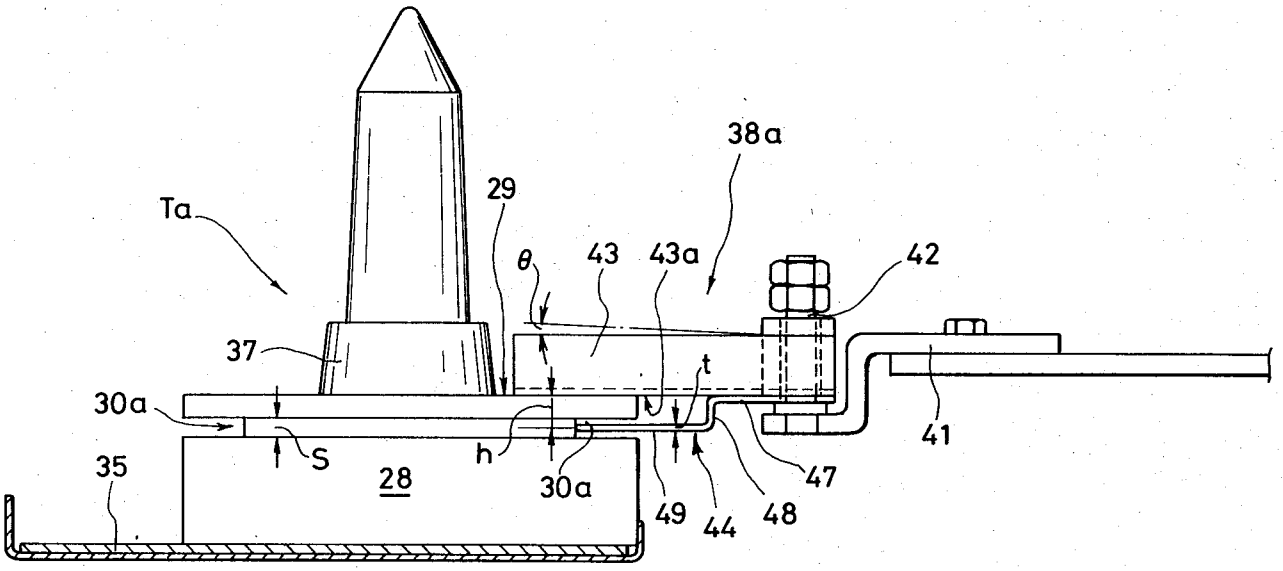
FIG. 6 is a side elevation of the same.
Figure 7:
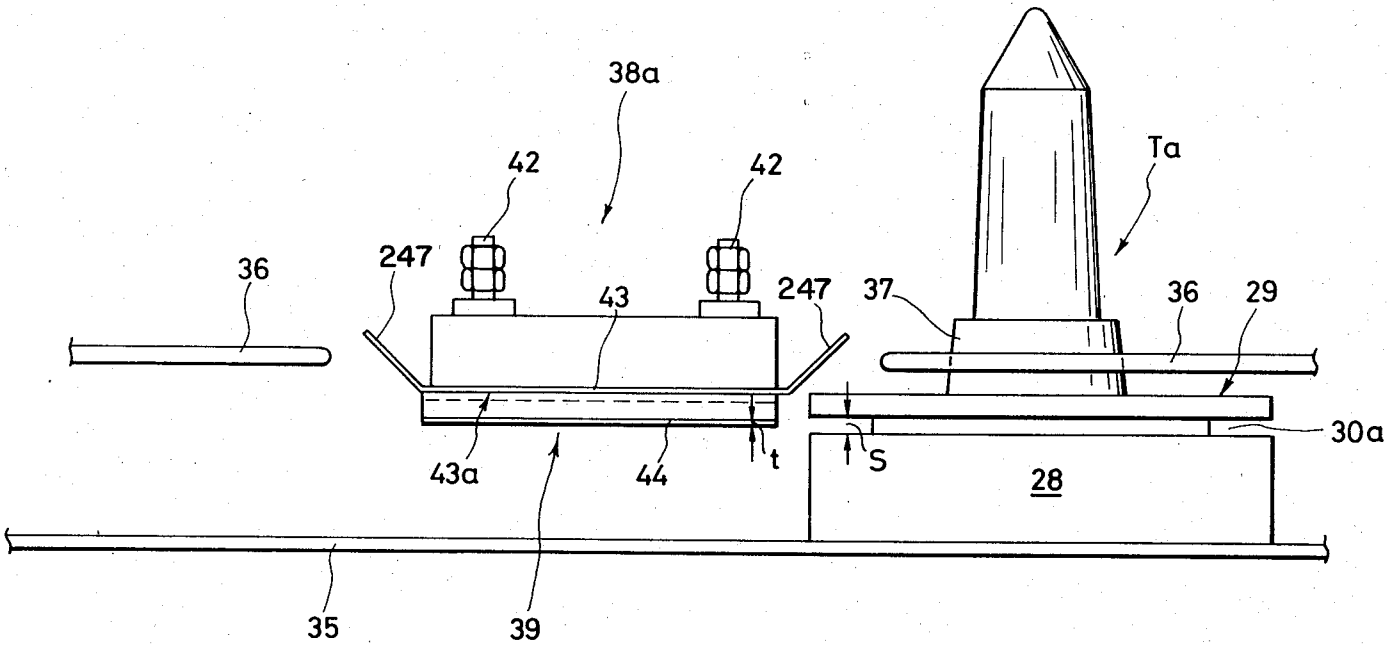
FIG. 7 is a front elevation of the same.

On the other hand, the aforementioned selecting guage 44 is formed, as shown in FIG. 6, by the sheet metal working of: a mounted portion 47 which is mounted on the reference plate 43; an upright portion 48 which is bent upright from said mounted portion 47; and a gauge portion 49 which is bent at an angle of approximately 90° from the vertical portion 48. The gauge portion 49 is made of a sheet metal having a sufficiently smaller thickness t than the width S of the groove 30*a* of the carrier Ta. Said gauge 44 is fixed by means of screws or welded in parallel all over its area to the reference face 43*a* of the aforementioned reference plate 43. Still moreover, the guide edge of the gauge 44 is formed of: sloped portions 50 and 51 which are sloped toward the central portion of the conveyor 35; and a parallel portion 52 which is formed at a crest between said sloped portions 50 and 51.

On the other hand, the guide plate 36 at the side facing the aforementioned selecting member 39 is formed with: a sloped face 53 for pushing the carrier toward the gauge 44; a parallel portion 54; a sloped portion 55 which is so sloped that the carrier failing to enter the branch line may be guided along the path; a parallel portion 56 for forcing the carrier straight toward the guide member 40; a sloped or curved portion 57 which leads from said parallel portion 56 and which is suitable for transferring the carrier distributed by the guide member 40 on the main conveyor line 2; and a parallel portion 58.

Moreover, the selecting guide member 40 is formed with a sharp leading end portion 59 generally at the center of the conveyor belt 35, and its one guide edge 60 leading from said leading end portion forms a path for advancing the carrier into the branch line 8*a* under consideration together with the sloped face 46 of the guide member 43 whereas its other guide edge 61 forms the main conveyor line 2 together with the parallel portion 58 of the facing guide plate 36. Incidentally, the leading end portion 59 of the aforementioned selecting guide member 40 is positioned such that the gauge 44 is positioned in the groove 30*a* of the carrier entering the branch path 8*a* being discussed so that the carrier Ta having passed has its center Oa displaced a distance $l_1$ to the branch path 8*a* from an abutment point Xa between the leading end portion 59 and the tray pedestal, and such that, when the carriers Tb to Te having no groove at positions corresponding to the aforementioned gauge 44 are forced to the guide plate 36 by the gauge 44 to abut against the leading end portion 59, said carrier Tb has its center Ob displaced a distance $l_2$ from an abutment point Xb to the main carrier line 2.

The selecting devices 38*a* to 38*e* thus constructed are disposed at the inlet side of the individual branch paths of the bobbin supply zone 6. Incidentally, the individual selecting devices 38*a* to 38*e* are different from one another only in that their selecting gauges are positioned at the same level as the groove positions of the corresponding carriers. Specifically, the gauge positions are so regulated that the distance h between the gauge 44 and the reference face 43*a*, as shown in FIG. 6, is the distance h2 equal to the groove 30*b* of the carrier Tb of FIG. 4*b* at the branch path 8*b* and is likewise distances h3, h4 and h5 in a consecutive order.

Next, the spinning bobbin supply stations P1 to P5 disposed midway of the aforementioned branch lines 8*a* to 8*e* will be explained in the following. Incidentally, since all the stations are different only in the kinds of the spinning bobbins to be handled but similar in the supply mechanisms, the following description is not limited to the spinning bobbin supply device of the station P1.

Figure 8:
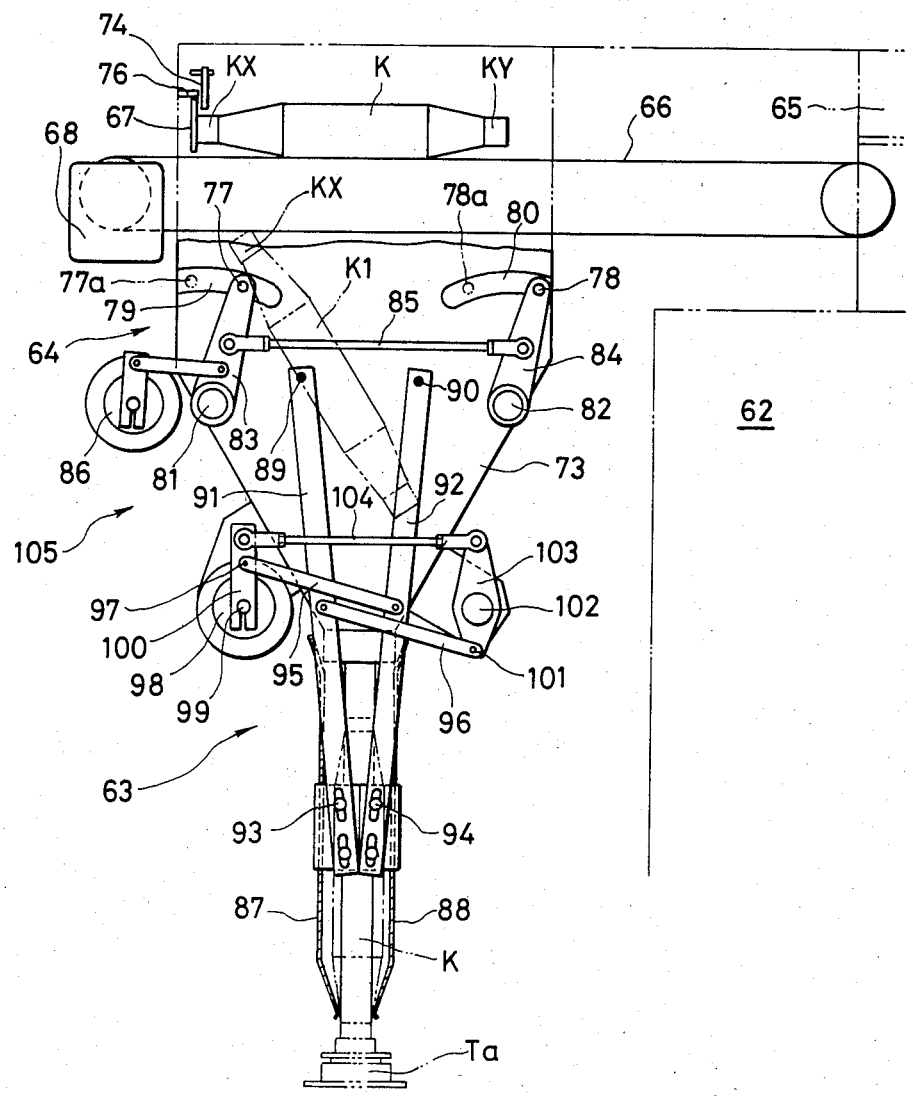
FIG. 8 is a front elevation showing one example of the bobbin supply device.
Figure 9:
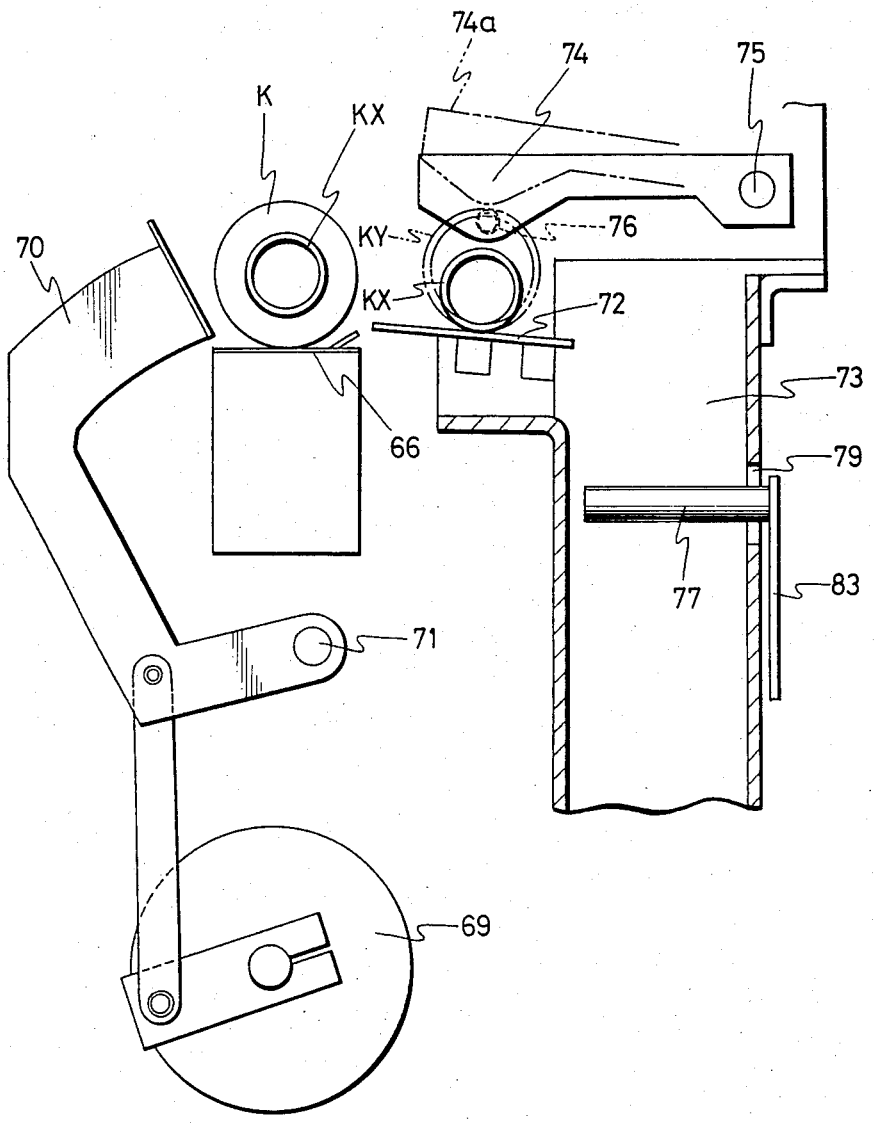
FIG. 9 is a side elevation showing the bobbin direction detecting device.

The spinning bobbin supply station P1 is constructed, as shown in FIG. 8, of: a spinning bobbin feeder 62 for storing a number of spinning bobbins at random in advance to transfer them separately one by one by making use of high-frequency oscillations; a spinning bobbin guide device 63 for fitting the spinning bobbin, which is fed from said spinning bobbin feeder 62 shown in FIGS. 8 and 9, on an empty carrier standing by therebelow; and a spinning bobbin direction regulator 64 for regulating the direction of the spinning bobbin when the latter falls.

As shown in FIG. 8, a spinning bobbin K, which is carried on a belt conveyor 66 disposed subsequent to the outlet 65 of the spinning bobbin feeder 62, comes into abutment against a spinning bobbin end detecting member 67 to stop a motor 68 for the conveyor 66 so that the spinning bobbin is halted at the position K of solid lines. After that, by the drive of a rotary solenoid 69 of FIG. 9, a pushing arm 70 is swung clockwise on a pin 71 to roll on a guide plate 72 the take-up tube KX of the spinning bobbin on the conveyor 66 thereby to drop it into a chute 73. At this time, above the guide plate 72 at one side of the guide plate for bearing and guiding the take-up tube KX at both ends of the spinning bobbin, there is disposed a bottom discriminating feeler 74 which is made active in accordance with the diameter of the take-up tubes. As shown in FIG. 9, the feeler 74 does not act, when the top KX of the bobbin, i.e., the small-diameter portion passes, but is displaced around a pin 75 to a position 74*a* of double-dotted lines, when the bottom portion KY having a large diameter passes, so that a contactless sensor 76 acts.

As a result, in case the spinning bobbin K is conveyed in a direction to have its top KX positioned at the side of the feeler 74, as shown in FIG. 8, this feeler 74 is not displaced when the arm 70 forces the spinning bobbin from the conveyor 66 to the chute 73 in said state. As a result, direction regulating pins 77 and 78 are continuously held in the positions of solid positions. Those pins 77 and 78 protrude through slots 79 and 80 of the chute into the two positions of the chute 73, as shown in FIG. 9, and are so spaced that, when the spinning bobbin drops, only its top KX abuts against the pins 77 and 78. More specifically, the aforementioned pins 77 and 78 are pivoted in the leading ends of a pair of levers 83 and 84 which are hinged to fixed shafts 81 and 82, and those levers 83 and 84 are made coactive by the operation of a rotary solenoid 86 through a rod 85 connecting the levers 83 and 84 so that the pins 77 and 78 move in parallel in the same direction.

As a result, the spinning bobbin K1, which is poured in the state of FIG. 9 into the chute 73 has its top KX abutting against the pin 77 and drops into guide chutes 87 and 88 with its bottom KY positioned below so that its bottom is inserted into the lower carrier Ta. On the other hand, the spinning bobbin, which has been conveyed on the conveyor 66 in a direction to have its bottom KY positioned at the side of the detecting member 67, displaces the feeler 74 when it is started by the starting arm 70. As a result, the rotary solenoid 86 acts to bring the pins 77 and 78 into positions 77*a* and 78*a* of double-dotted lines. The spinning bobbin has its top abutting against the pin 78*a*, when it drops, so that it drops, too, with its bottom positioned below. In any case, the spinning bobbin never fails to have its bottom fitted on the carrier.

Incidentally, the guide chutes 87 and 88, which lead from the stationary chute 73, are so supported as to swing on pins 89 and 90 in the directions opposite to each other so that they take their closed positions, only when the spinning bobbin is to be fitted, and their open positions when the carrier is to be moved. More specifically, the guide chutes 87 and 88 are fixed by means of screws 93 and 94 to arms 91 and 92, which depend in a manner to swing on the stationary pins 89 and 90, and, in the state of FIG. 8 in which the guide chutes 87 and 88 are closed, the spinning bobbin K1 dropping in the chute 73 has its surrounding regulated and guided by the guide chutes 87 and 88 until the guide chutes 87 and 88 have their positions regulated such that the spinning bobbin k1 may be fitted on the peg of the lower carrier Ta. To the intermediate portions of the aforementioned arms 91 and 92, there are connected one-side ends of levers 95 and 96, of which the other end 97 of the lever 95 is connected to a drive lever 100 fixed to the shaft 99 of a rotary solenoid 98 whereas the other end 101 of the lever 96 is connected to one end of a rocking lever 103 capable of rocking on a fixed pin 102. Moreover, a rod 104 is connected between the aforementioned drive lever 100 and rocking lever 103, and the rocking arms 91 and 92 are rocked apart from each other as a result that the drive lever 100 turns clockwise a predetermined angle from the position of FIG. 8 so that the guide chutes 87 and 88 take their closed positions.

Figure 12:
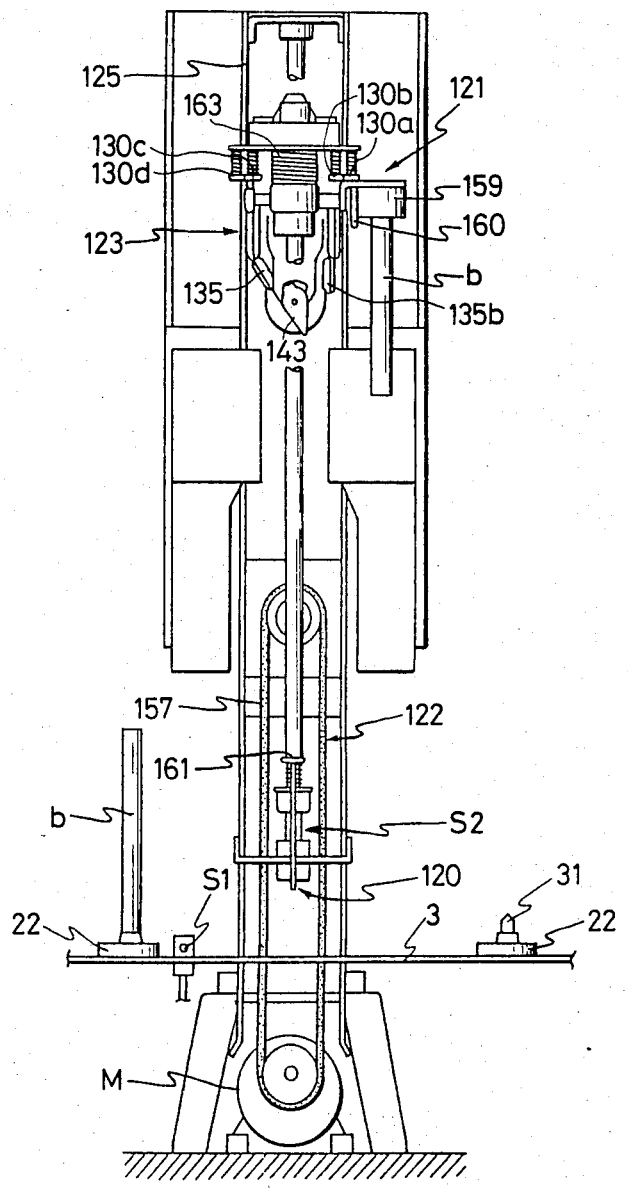
FIG. 12 is a front view showing one embodiment of a yarn handling device.
Figure 13:
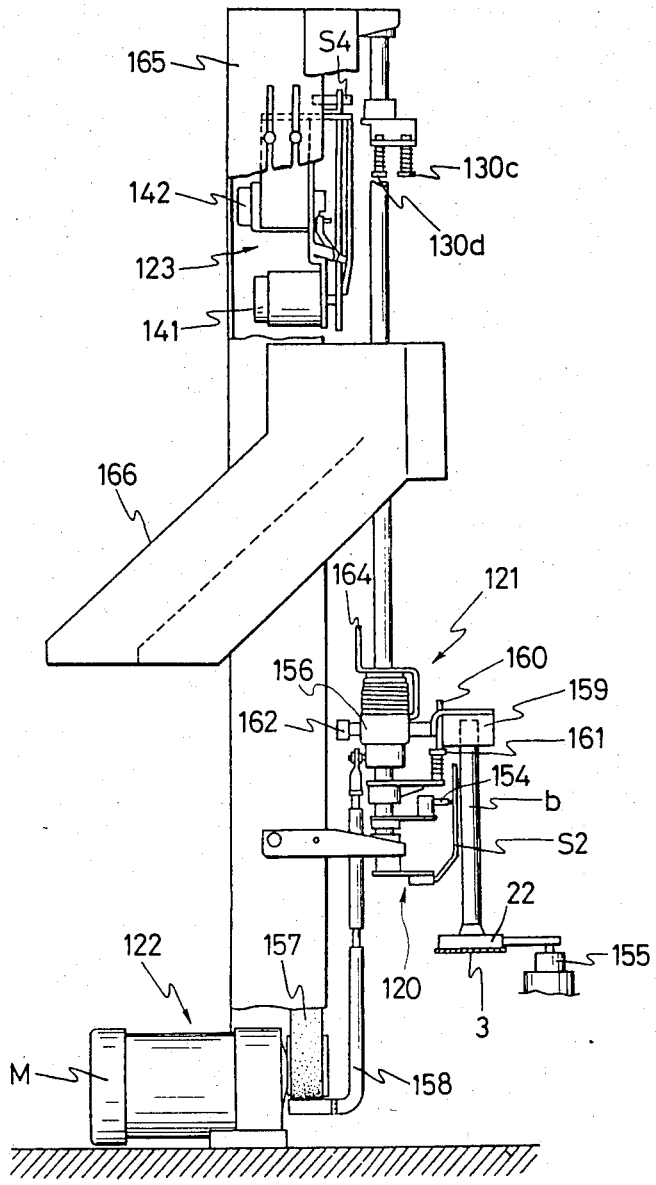
FIG. 13 is a side view showing the device in FIG. 12.

FIGS. 12 and 13 show an embodiment of the aforementioned bobbin handling device. In the present device, the bobbins b, which have their yarns taken up by the automatic winder and have been discharged, are fitted on the pegs 31 of the disc-shaped carriers 22 and are conveyed in an upright position on the bobbin return path 3 of the belt conveyor.

It is assumed here that the individual bobbins b are supported on the carriers 22 of five kinds in accordance with the kinds of the aforementioned yarns. The kinds of the carriers 22 are indicated either by discrimination marks applied to the circumferences of the carriers or by the colors or shapes of the carriers so that they are judged by a later-described sensor. The present device is constructed of: a judging device 120 arranged in the vicinity of the aforementioned bobbin return path 3 for judging the carriers 23 and the bobbins b, which are conveyed on said bobbin return path 3, to allow them to pass therethrough or not; a bobbin chuck device 121 for chucking the upper end of the bobbin b which has been stopped by said device 120; an elevator 122 for moving up and down said chuck device 121; and a guide device 123 for guiding the movement of said chuck device 121.

Figure 14:
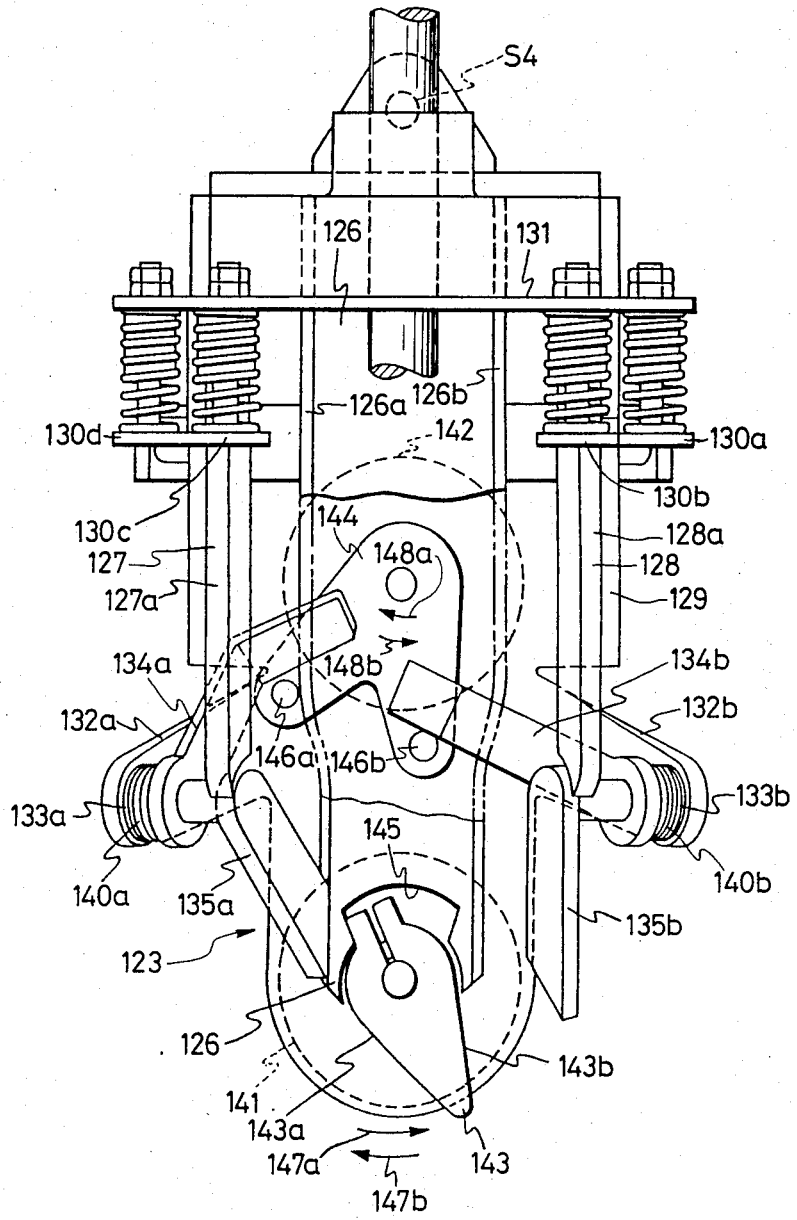
FIG. 14 is a front view showing a guide device.

The guide device 123 is disposed above a frame 125, as shown in FIGS. 12 to 14, and is composed of three guide plates 126, 127 and 128, a variety of switches, and a base 129 for supporting them. The aforementioned guide plates involved are the central guide plate 126, which is positioned at the center and has guide faces 126*a* and 126*b* at both its sides, and the left and right guide plates 127 and 128 which are positioned at both the sides of the central guide plate 126 and has guide faces 127*a* and 128*a* at their respective outer sides. The guide plates thus far described are fixed on the aforementioned base 129 together with a stopper supporting plate for supporting stoppers 130*a*, 130*b*, 130*c* and 130*d*. From both the sides of said base 129, there extend arms 132*a* and 132*b* having at their leading ends pins 133*a* and 133*b*, on which operation levers 134*a* and 134*b* and guide levers 135*a* and 135*b* are hingedly supported altogether. These guide levers 135*a* and 135*b* are also formed with guide faces at their respective outer sides so that they can provide, when in the swinging motions, smooth communications between the respective leading end portions of the central guide plate 126 and the left and right guide plates 127 and 128. Incidentally, reference characters 140*a* and 140*b* indicate torsion springs which are disposed on the aforementioned pins 133*a* and 133*b* for returning the guide levers 135*a* and 135*b*. To the back of the central guide plate 126, there are fixed two rotary solenoids 141 and 142 having shafts, to which in turn are fixed switch members 143 and 144. Of these, the lower first switch member 143 is positioned in a notch 145, which is formed at the lower end of the central guide plate 126, and has its two pins 146*a* and 146*b* fixed on one end of the upper second switch member 144. The first switch member 143 is so sharpened as to have guide faces 143*a* and 143*b* at both its sides and is adapted to be turned in the directions of arrows 147*a* and 147*b* by energization of the first rotary solenoid 141. The second switch member 144 is adapted to be turned in the directions of arrows 148*a* and 148*b* by energization of the second rotary solenoid 142 so that the pins 146*a* and 146*b* alternately push up the aforementioned operation levers 134*a* and 134*b* when in the turning motions, whereby the individual guide levers 135*a* and 135*b* provide communications or releases between the central guide plate 126 and the left and right guide plates 127 and 128.

Next, the operations of the bobbin handling device thus far described will be explained in the following.

When the carriers 22 supporting the bobbins b come on the bobbin return conveyor 3, a first sensor S1 first judges the kind of the carrier 22 in terms of the discrimination mark thereof. Then, the rotary solenoid 141 is energized so that the first switch member 143 takes the position shown in FIG. 14. Next, in case a second sensor S2 fails to detect yarn on the bobbin, namely, in case the bobbin has no yarn left, said bobbin is either empty one or one having small amount of yarn. In either event, a tray stopping device 155 shown in FIG. 13 operates to stop the aforementioned carrier 22 in a predetermined position. An elevating member 156 has its uppermost position used as a stand-by position, and a motor M is driven, simultaneously as the carrier 22 is halted in the position, to start the run of the belt 157 so that the elevating member 156 connected to said belt 157 through an L-shaped member 158 starts its downward movement quietly. When the elevating member 156 comes to its lowermost position, a chucker 159 has its pin 160 abutting against the stopper 161 to turn the cam member in the chucker. At this time, the upper end of the bobbin b halted by the aforementioned carrier stopping device 155 is inserted into the chucker 159 so that said upper end is pushed by the aforementioned cam member to cause the bobbin b to be chucked by the chucker 159. The elevating member 156 is shifted from this state to its rising course to extract the bobbin b from the carrier 22. After that, the carrier stopping device 155 is caused to release the empty carrier 22 by the action of a not-shown timer.

When the aforementioned chucker rises, the bobbin does not displace a left yarn detecting member 154 of FIG. 13 in case the bobbin chucked by the chucker 159 is empty. As a result, the second switch member 144 shown in FIG. 14 is held in the position of solid lines. Simultaneously as the first sensor S1 detects the carrier, said second switch member 144 has its pin 146*a* elevating one operation lever 134*a* by the rotary solenoid 142 so that the guide lever 135*a* is positioned together with said lever 134*a* in the position shown in FIG. 14.

As a result, during the rise of the chucker 159, a cam follower 162 of the elevating member 156 comes into abutment against the first switch member 143 to move from the lefthand guide face 143*a* of the member 143 through the central guide plate 126 and the lefthand guide lever 135*a* to the guide face 127*a* of the lefthand and guide plate 127. In accordance with this, the bobbin chuck device 121 rises, while turning by 90 degrees, against the biasing force of the torsion spring 163 until it comes into the position shown in FIG. 12. When the bobbin chuck device 163 reaches its uppermost position, its projection 164 is detected by a fourth sensor S4 to stop the drive of the motor M. Simultaneously with this, the pin 160 of the chucker 159 is pushed downward by the stopper 130*a* so that the bobbin b is released to drop into the chute 166 which is fixed on the frame 165.

In case the bobbin chucked has a little yarn, on the other hand, a left yarn detecting member 167 comes into engagement with the left yarn to turn while the chucker 159 is rising. As a result, the contactless sensor operates so that the second switch member 144 turns in the direction of arrow 148*b*, as viewed in FIG. 14, and the guide lever 135*a* has its connection with the central guide plate 126 disconnected as in the lever 135*b* so that the cam follower 162 of the bobbin chuck device 121 is guided from the guide face 143*a* to the guide face 126*a* to take its position 130*b* at the uppermost end of the chucker. Then, the small amount of yarn bobbin, which has been released at said position, is discharged through another chute into a stock box or out of the empty bobbin conveyor path.

If the carrier 22 having been conveyed on the bobbin return conveyor 3 belongs to another kind, on the other hand, the first switch member 143 is brought by the first sensor S1 into the position turned in the direction of arrow 147*b*, whereupon the cam follower 162 is guided along the right guide face 126*b* of said first switch member 143.

The operations of the system arranged with the various devices thus far described according to the present invention will be described in the following.

As shown in FIGS. 1 and 2, various kinds of spinning bobbins such as empty bobbins, small amount of yarn bobbins and partial-bobbins, which are discharged at random from the respective winding sections SC1 to SC5 of the winder W onto the bobbin return path 3, are transferred onto the main conveyor line 2. Along this line 2, first of of all, the small amount of yarn bobbins and the empty bobbins are extracted from their carriers at the bobbin handling zone 5. At the bobbin handling device R12, more specifically, two kinds of carriers Ta and Tb are handled such that the small amount of yarn bobbin on the carrier Ta is extracted and accommodated in an accommodating box B1, whereas the empty bobbin on the carrier Ta is either returned to a corresponding fine spinning frame or accommodated in the empty bobbin box by a not-shown carrier line, e.g., an empty bobbin conveyor line laied on the ceiling. At the bobbin handling device R34, likewise, the bobbins on the two kinds of carriers Tc and Td are handled, whereas the bobbin on the remaining carrier Te is handled at the bobbin handling device R5.

Of the various carriers having passed through the bobbin handling zone 5, therefore, the empty carrier having no bobbin or the carrier having the partial bobbin is exclusively carried.

When the bobbin supply zone 6 is subsequently reached, by the selecting device 38*a* of FIGS. 5 to 7, which is disposed at the inlet side of the first branch line 8*a*, only the carrier Ta of FIG. 4 is taken into the branch line 8*a* by the aforementioned action and is conveyed on the branch line 8*a* toward the bobbin supply station P1. When a predetermined position of said station is reached, the carrier Ta is halted by a not-shown stopper, and it is confirmed by the sensor that the tray exists and that no bobbin exists on the carrier. After that, a bobbin supply device 105 shown in FIGS. 8 and 9 operates one cycle so that a new spinning bobbin K on the conveyor 66 is supplied and fitted on the empty carrier Ta. When the bobbin is fitted, the aforementioned bobbin absence confirming sensor confirms the presence of the bobbin to release the stopper so that the carrier Ta having a predetermined spinning bobbin fitted thereon is further conveyed on the branch line 8*a* in the direction of array 106 merge into the main carrier line 2 until it is conveyed on said line 2 toward the yarn end finding device 7. Incidentally, the carrier having reached the aforementioned bobbin supply station P1 passes without any supply of the spinning bobbin, when the partial-bobbin exists, until it is forwarded to the yarn end finding device.

Of the carriers conveyed on the main conveyor line 2, moreover, the carrier (as indicated at Tb in FIG. 4) for the spinning bobbin b passes without advancing into the branch line 8*a* and is taken into the branch line 8*b* by the selecting device 38*b* which is disposed at the inlet side of the branch line 8*b*. Since said selecting device 38*b* has its gauge 44 of FIG. 6 positioned at a distance h2 from the reference face 43*a*, only the carrier Ib having its groove 30*b* positioned at the distance h2 from the reference face 29 of the carrier is allowed to advance into the branch line 8*b*.

In these ways, subsequently, the carrier Tc, the carrier Td and the carrier Te are mechanically selected and taken into the branch lines 8c, 8d and 8e, respectively, so that the spinning bobbins of the predetermined kinds are fitted on the corresponding carriers by the bobbin supply device 105 similar to the aforementioned one.

Figure 10:
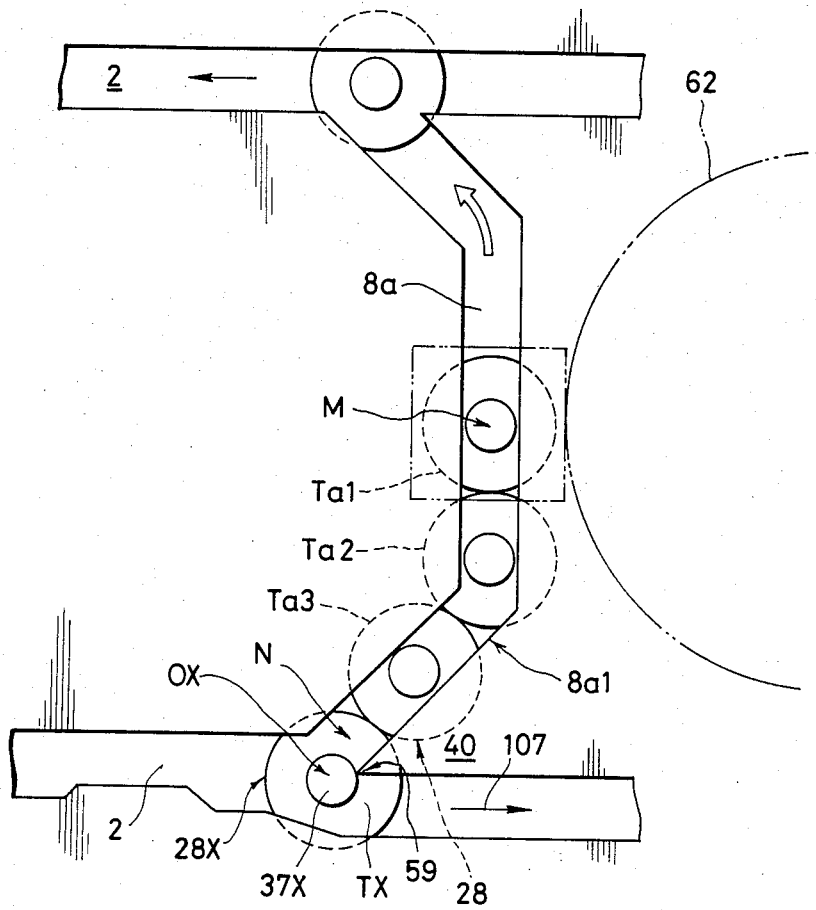
FIG. 10 is an enlarged top plan view showing the branch lines.

Incidentally, the aforementioned individual branch lines 8a to 8e are sized, as shown in FIG. 10, such that, when a stand-by line 8a1 between a bobbin supply position M and an inlet port N of the carrier Ta is filled with several (e.g., three, as shown) carriers, a succeeding carrier TX is sent out onto the main conveyor line 2 no matter which it might be of the same kind or of the different kind as or from the carrier Ta on the branch line under consideration. More specifically, the stand-by line 8a1 of the branch line 8a is set such that, in the state in which the base 28X of the succeeding carrier TX abuts against the base 28 of the rearmost carrier Ta3 on the stand-by line 8a1, the center 0X of the pedestal 37X of the carrier TX takes the position, in which it is displaced from the leading end portion 59 of the selecting guide member 40 to the main conveyor line 2, i.e., the position Tb of double-dotted lines Tb of FIG. 5.

As a result, even if a predetermined number of carriers occupy the stand-by line of one or plural branch lines 8a to 8e, the succeeding carriers are conveyed on the main conveyor line in the direction of arrow 107 without being delayed at the inlet side of the branch lines concerned so that they are supplied again to the yarn end finding device 7 or returned from the upstream of the yarn end finding device 7 onto the main conveyor line 2 between the bobbin handling zone 5 and the bobbin supply zone 6, whereby they are prevented from raising any obstruction to conveyance of the carriers or spinning bobbins.

Moreover, the carrier having the spinning bobbin fitted thereon is conveyed on the main conveyor line 2 and is supplied to the yarn end finding device 7, in which its yarn end is sought and brought into a position depending into the take-up tube of the bobbin from the upper end of the same, until it is carried toward the winder W. In this winder W, various kinds of carriers carried at random on the main conveyor line 2 of FIG. 2 are transferred through the branch lines 27a to 27e to the bobbin distribution paths 10a to 10e of closed loop shape, which are disposed in the winding sections SC1 to SC5, respectively. At the inlet sides of said branch paths 27a to 27e, there are disposed selecting devices which are similar to the aforementioned carrier selecting devices shown in FIGS. 5 to 7, so that predetermined carriers, i.e., spinning bobbins are automatically sorted and supplied to the predetermined winding sections by the actions similar to the aforementioned ones.

Figure 11:
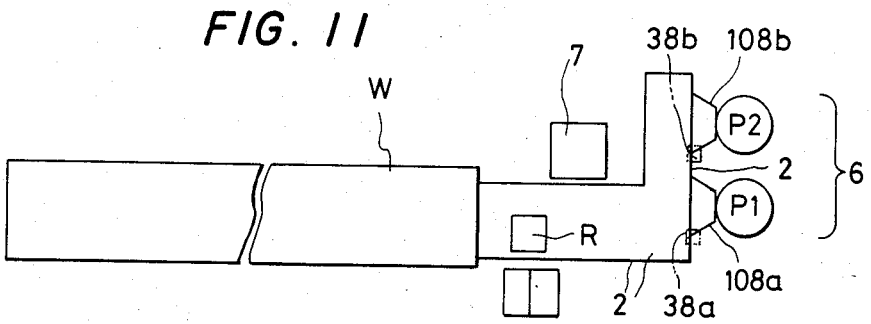
FIG. 11 is a top plan view showing the layout of another embodiment of the system of the present invention.

FIG. 11 shows another embodiment indicating the relationship between the main conveyor line 2 and branch lines 108a and 108b of the carriers in the bobbin supply zone 6. In the case of the aforementioned embodiment, more specifically, the branch lines 8a to 8e are arranged generally at a right angle with respect to the main conveyor line 2 extending through the zone 6. In FIG. 11, on the contrary, the branch lines 108a and 108b are arranged generally in parallel with the main conveyor line 2. Letters W and R indicate a winder and a bobbin handling device, respectively, and numeral 7 indicates a yarn end finding device. In the case of the present embodiment, too, only a predetermined carrier can be taken by the selecting devices 38a and 38b from the main line 2 into the bobbin supply station like the foregoing embodiment, and the excess carriers can pass on the main conveyor line even in case the stand-by lines of the branch lines are filled up with a predetermined number of carriers.

The arrangement relationship between the aforementioned main conveyor line and branch lines, or the number of the branch lines and the branch supply stations can be arbitrary set in accordance with the kinds of yarns to be re-wound. Moreover, the bobbin feeder 62 can be dispensed with, and direct connection with a fine spinning frame can be made. Still moreover, the bobbin handling zone shown in FIG. 2 may also be equipped with branch lines similar to those of the foregoing embodiment, and the bobbin handling device may be arranged midway of said branch lines.

In the foregoing embodiments, incidentally, the carrier member are exemplified by the peg carriers, and the supply articles are exemplified by the spinning bobbins. However, mere article accommodating boxes or pallets may be used as the carrier members, and small articles such as screws or balls may be used as the articles to be handled. In this modification, conveyor belts or roller conveyors are used as the carrier lines, and indicative marks indicating the kinds of the articles to be accommodated are adhered to the surfaces of the boxes or pallets so that a pressure member for pressing said boxes onto the branch lines may be operated in response to the signal of a mark sensor, which is disposed at the inlet sides of the branch lines for reading out the aforementioned marks, to selectively take in the carrier members.

As has been described hereinbefore, according to the present invention, the conveying system comprises: the common main conveyor line for carrying the articles of different kinds; the branch lines branched from and merging again into said main conveyor line; and the stations disposed midway of said branch lines for handling the articles of different kinds. As a result, these articles conveyed at random on the main conveyor line can be distributed to the especial branch lines so that the articles can be handled midway of said branch lines, whereby the articles of different kinds being carried can be handled remarkably smoothly without any delay on the main conveyor line. In other words, the specified articles can be conveyed on the main conveyor line to the corresponding especial branch lines while passing through the other branch lines.

At the processing stations, moreover, only the articles which have been taken in the branch lines of said stations are handled. As a result, if only the kinds of the articles to be taken at the inlet sides of the branch lines are confirmed, what has to be conducted at the handling stations may be nothing but to handle the articles so that the handling operation can be efficiently conducted.

What is claimed is:

1. A bobbin conveying and handling system for conveying various kinds of spinning bobbins between a winder and a plurality of bobbin supply stations, each of said spinning bobbins being erected on a respective carrier member, said system comprising: a first conveyor for transporting said carrier members bearing spinning bobbin from said supply stations to said winder; a second conveyor for transporting said carrier members bearing spinning bobbins from said winder to said supply stations;

a plurality of branch conveyors for transporting said carrier members from said second conveyor to said first conveyor, each one of said branch conveyors being positioned adjacent a respective one of said supply stations; and means adjacent said second conveyor and intermediate said winder and said supply stations for extracting from said carrier members those spinning bobbins having less than a predetermined amount of yarn thereon.

2. A bobbin conveying and handling system as claimed in claim 1, wherein each of said bobbin supply stations further comprises: a spinning bobbin feeder means for storing a number of said spinning bobbins, a spinning bobbin guide means for fitting each of said stored spinning bobbins on an empty carrier member, and a spinning bobbin orientation regulator for regulating the orientation of said stored spinning bobbins with respect to said empty carrier members as said stored spinning bobbins are fitted on said empty carrier members.

* * * * *